US006533354B2

(12) United States Patent
Ko

(10) Patent No.: US 6,533,354 B2
(45) Date of Patent: Mar. 18, 2003

(54) SWIVELING CHAIR

(76) Inventor: Hui Chu Ko, 2701 Quail Ridge, Carrollton, TX (US) 75006

( * ) Notice: Subject to any disclaimer, the term of this patent is extended or adjusted under 35 U.S.C. 154(b) by 0 days.

(21) Appl. No.: 09/683,915

(22) Filed: Mar. 1, 2002

(65) Prior Publication Data

US 2002/0084684 A1 Jul. 4, 2002

(51) Int. Cl.[7] ..... A47C 1/02

(52) U.S. Cl. ..... 297/344.21; 297/344.22; 297/451.8; 297/451.2

(58) Field of Search ..... 297/344.22, 344.21, 297/440.22, 451.8, 463.1, 463.2, 337, 451.2

(56) References Cited

U.S. PATENT DOCUMENTS 2,293,144 A * 8/1942 Jones
2,567,004 A * 11/1951 Fair
3,166,030 A * 1/1965 Ludvigsen
3,393,941 A * 7/1968 Grosfillex
3,751,109 A * 8/1973 Dufton
4,544,202 A * 10/1985 Keaton
5,110,181 A * 5/1992 Simjian
6,270,162 B1 * 8/2001 Jeny

FOREIGN PATENT DOCUMENTS

GB 2154868 * 2/1985

* cited by examiner

*Primary Examiner*—Laurie K. Cranmer
(74) *Attorney, Agent, or Firm*—Haynes and Boone, LLP

(57) ABSTRACT

A swiveling chair is described. The swiveling chair has a back portion, a seat portion attached to the back portion, a swiveling component attached to the seat portion, a leg support attachment attached to the swiveling component, wherein the leg support attachment has at least three leg openings, and at least three chair legs attached to the leg support attachment, wherein the at least three legs attach to the leg support attachment at the at least three leg openings and wherein the at least three legs attach at an angle from a perpendicular line to the leg support attachment to a center line in each of the at least three legs and wherein the angle is between 35 and 55 degrees.

10 Claims, 3 Drawing Sheets

SWIVELING CHAIR

BACKGROUND OF THE INVENTION

The invention relates generally to furniture and specifically to chairs.

Currently, many different types of chairs exist that swivel. However, most of them are tall and used as bar stools. One drawback to the current models is that because of the tall height, most of the current swiveling chairs can not be used as dining chairs.

In the furniture industry, the chair assembly uses standard components. For example, the country style chairs use two or three different types of legs, and each of them comes with fixed length and diameter (at the end). The swiveling bar stools have to use legs of special length so that the increase of height of the seat due to the inclusion of an attached swiveling mechanism can be adjusted by using the legs of an appropriate length. Such an arrangement is difficult for chairs other than bar stools because they have a lower seating height, and for various other reasons, they have to use standard legs.

SUMMARY OF THE INVENTION

The present invention includes a swiveling chair and a method to produce such. The swiveling chair fits comfortably under a standard table such as a dining table. In addition, the swiveling chair has a stabilizing mechanism to impede the chair from swiveling.

A swiveling chair is described. In one example, the swiveling chair has a back portion, a seat portion attached to the back portion, a swiveling component attached to the seat portion, a leg support attachment attached to the swiveling component, wherein the leg support attachment has at least three leg openings, and at least three chair legs attached to the leg support attachment, wherein the at least three legs attach to the leg support attachment at the at least three leg openings and wherein the at least three legs attach at an angle from a perpendicular line to the leg support attachment to a center line in each of the at least three legs and wherein the angle is between 35 and 55 degrees.

In another example, the swiveling chair has its back portion connected directly to the leg support attachment and the seat portion can swivel independently without moving the back portion.

Therefore, in accordance with the previous summary, objects, features and advantages of the present invention will become apparent to one skilled in the art from the subsequent description and the appended claims taken in conjunction with the accompanying drawings.

DETAILED DESCRIPTION

The present invention can be described with several examples given below. It is understood, however, that the examples below are not necessarily limitations to the present invention, but are used to describe typical embodiments of operation.

Figure 1:
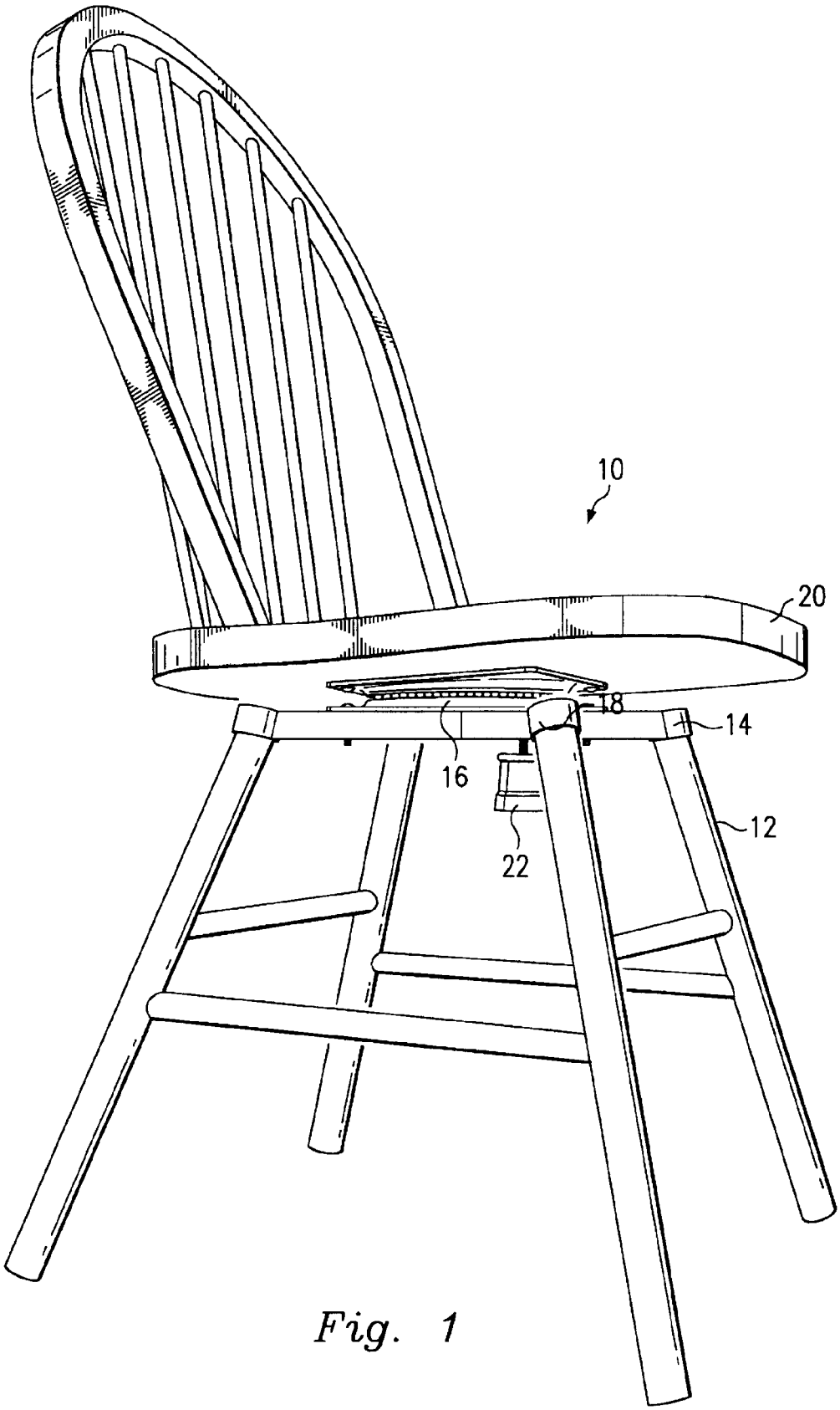
FIG. 1 shows an example of the preferred embodiment.

Now turning to FIG. 1, a view of a chair 10 is shown according to one example of the present invention. The chair 10 is shown with four legs 12, a leg support/attachment (leg support) 14, a swiveling component having a bottom swiveling mechanism 16 and a top swiveling mechanism 18 which is further attached to a seat 20 of the chair 10. Also shown is a swivel stabilizer 22 that prevents the chair 10 from swiveling when needed.

Figure 2:
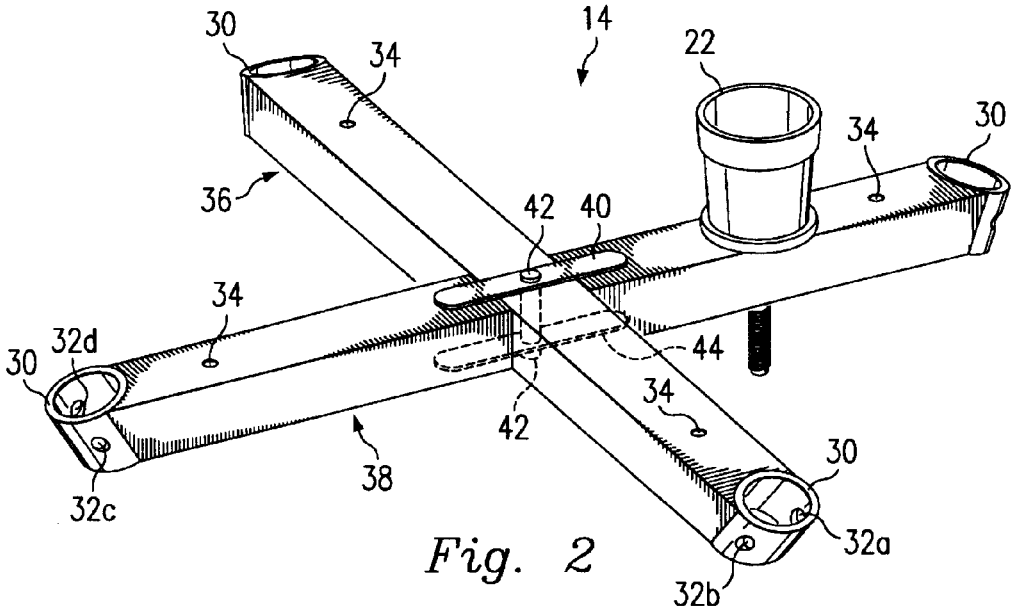
FIG. 2 shows an exemplary design of the leg support/attachment mechanism.

Now turning to FIG. 2, an example of a leg support 14 is shown. Legs (not shown in this figure) attach to the leg support 14 at the four leg openings 30. The leg support 14 can be made of wood, metal or any other rigid material. The four leg openings 30 are preferably at about an angle between 35 to 55 degrees, preferably at 45 degrees, so as to lessen the height of the chair. In addition, stabilizing screws (not shown) are inserted into screw openings (e.g., 32*a* and 32*b*, or 32*c* and 32*d*) in order to stabilize the legs once they are inserted into the leg openings 30. Moreover, attachment screw holes 34 enable attachment screws (not shown) to attach the leg support 74 to the bottom swiveling mechanism 16 (not shown). After the legs are inserted into the openings and secured by the attachment screws, an additional spacer (not shown) can be further inserted in the openings between the interior surfaces of the openings and the legs. The spacer can be of different shapes and made of various materials (e.g., plastic or rubber).

Although it is not shown, this embodiment of the leg support 14 is created from support members 36 and 38 that are each notched in order to allow the other member to be joined seamlessly to form a cross. The cross can be joined by several methods, but in this embodiment, the members 36 and 38 are joined by a top plate 40, a nut 42 and a bottom plate 44 to secure the two members 36 and 38.

Figure 3:
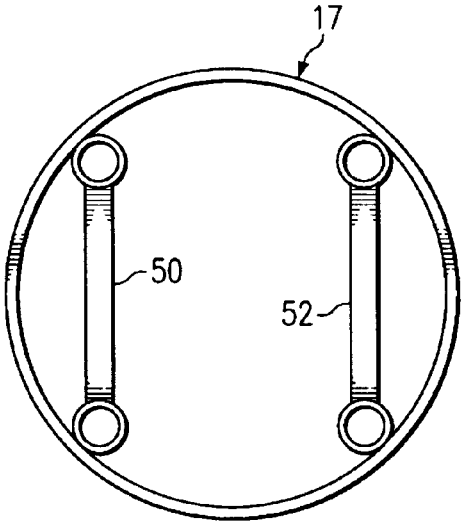
FIG. 3 shows another design of the leg support/attachment mechanism.

FIG. 3 shows an alternative embodiment made of two members 50 and 52 in parallel to each other and connected through a circular frame 17.

Figure 4:
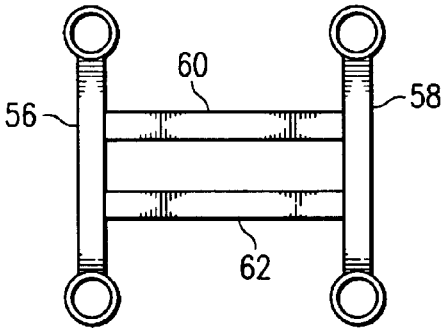
FIG. 4 shows another design of the leg support/attachment mechanism.

FIG. 4 shows another alternative embodiment made of two parallel members 56 and 58 and two cross members 60 and 62 joining the two parallel members 56 and 58.

Figure 5:
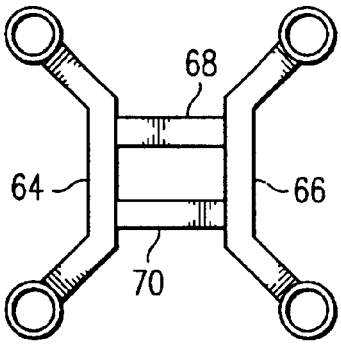
FIG. 5 shows another design of the leg support mechanism.

FIG. 5 shows another alternative embodiment made of two outer members 64 and 66 and two cross members 68 and 70 joining the two outer members 64 and 66.

Figure 6:
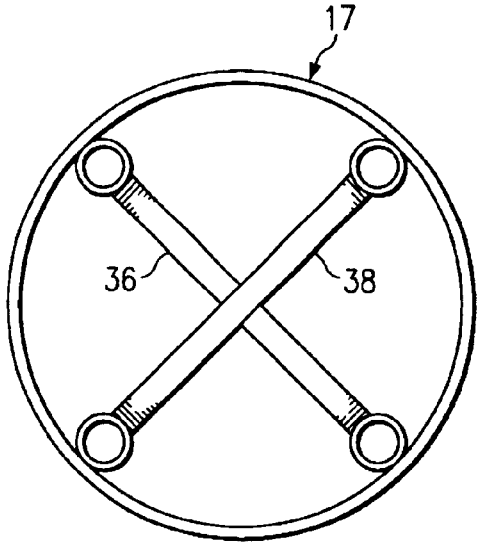
FIG. 6 shows another design of the leg support mechanism.
Figure 7:
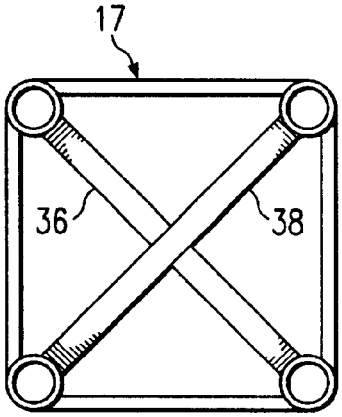
FIG. 7 shows another design of the leg support mechanism.

FIG. 6 shows members 36 and 38 attached to a circular frame 77. FIG. 7 shows members 36 and 38 attached to a rectangular shaped frame.

Figure 8:
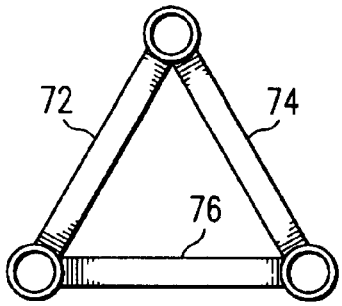
FIG. 8 shows another design of the leg support mechanism.

FIG. 8 shows three members 72, 74 and 76 joined together in a triangle shaped frame.

Figure 9:
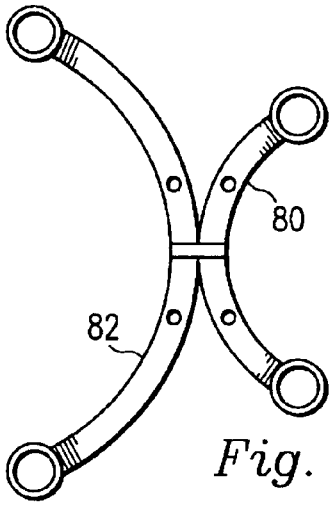
FIG. 9 shows another design of the leg support mechanism.

FIG. 9 shows an embodiment similar to FIG. 5, however, members 80 and 82 are arcs-shaped or semi-circular, and are joined with each other. The two members do not have to be the same size and shape. For example, depending on the size of the seat of the chair, one member (e.g., member 80) can have a smaller diameter than the other (e.g., member 82). In this example, the two members are connected to each other;

another example can have the members made from one piece of material. In addition, one member can be referred to as a front member because it is located in the front half of the chair and the other can be referred to as a back member. In addition, if standard chair legs are to be inserted into the leg support, openings (e.g., openings 84 and 86) are included. If no leg is inserted, then other connection mechanisms can replace the openings on the leg support. For example, in one embodiment of the present disclosure, the back member is connected directly to the back piece of the chair; then an appropriate connection needs to be made between the back piece and the leg support. This connection might be as simple as screw connections, and it might also be a two-piece connection wherein one piece extending from the back piece, e.g., cylinder shaped, and another one of a complimentary shape from the leg support, e.g., ring shaped, wherein the diameter of the ring is larger than that of the cylinder so that it can fit onto the cylinder to secure a strong connection. As such, the seat can independently swivel without moving the back piece or the leg support. In another example, the back piece extends all the way to the ground to become the rear base support of the chair so that two rear legs are eliminated. In this case, only the front member needs to connect to chair legs.

It is understood that several modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A swiveling chair comprising:

a back portion;

a seat portion attached to the back portion;

a swiveling component attached to the seat portion;

a leg support attachment attached to the swiveling component, wherein the leg support attachment includes three members which are formed together in a triangular fashion and has at least three leg openings; and at least three chair legs attached to the leg support attachment, wherein the at least three legs attach to the leg support attachment at the at least three leg openings and wherein the at least three legs attach at an angle from a perpendicular line to the leg support attachment to a center line in each of the at least three legs and wherein the angle is between 35 and 55 degrees.

2. The chair of claim 1 wherein the leg support attachment includes a stabilizing mechanism that impedes the chair from swiveling when needed.

3. The chair of claim 1 wherein the at least three leg openings include at least one stabilizing screw in each leg opening to keep each of the at least three legs in place.

4. The chair of claim 1 wherein the leg support attachment is wood.

5. The chair of claim 1 wherein the leg support attachment is metal.

6. The chair of claim 1 wherein the leg support attachment is a composite material.

7. The chair of claim 1 wherein the angle is approximately 45 degrees.

8. A swiveling chair comprising:

a seat portion;

a swiveling component attached to the seat portion; and a leg support attachment attached to the swiveling component, wherein the leg support attachment has at least one front member and two back members, the front and back members connecting together in a triangular fashion, wherein the leg support attachment receives at least one chair leg attached to the leg support attachment, wherein the leg attaches at an angle from a perpendicular line to the leg support attachment to a center line in the leg and wherein the angle is between 40 and 50 degrees.

9. The chair of claim 8 wherein the leg support attachment includes a stabilizing mechanism that impedes the chair from swiveling when the stabilizing mechanism is fully engaged.

10. The chair of claim 8 wherein the angle is approximately 45 degrees.

* * * * *